US006618897B2

(12) United States Patent
Lewis et al.

(10) Patent No.: US 6,618,897 B2
(45) Date of Patent: Sep. 16, 2003

(54) BROOM AND BLOWER CONTROL METHOD AND APPARATUS

(75) Inventors: Scott Lewis, Lakewood, CO (US); Mike Weege, Evergreen, CO (US); Greg Noah, Denver, CO (US)

(73) Assignee: S & S Trust, Commerce City, CO (US)

( * ) Notice: Subject to any disclaimer, the term of this patent is extended or adjusted under 35 U.S.C. 154(b) by 137 days.

(21) Appl. No.: 09/840,501

(22) Filed: Apr. 23, 2001

(65) Prior Publication Data

US 2002/0022908 A1 Feb. 21, 2002

Related U.S. Application Data

(60) Provisional application No. 60/199,053, filed on Apr. 22, 2000.

(51) Int. Cl.[7] ..... A47L 7/02; A47L 9/28

(52) U.S. Cl. ..... 15/340.3; 15/319; 15/368; 15/383

(58) Field of Search ..... 15/340.3, 368, 15/383, 319, 78, 82; 37/196, 219, 233, 234, 241

(56) References Cited

U.S. PATENT DOCUMENTS 3,735,510 A * 5/1973 Godfrey et al. ..... 15/340.3
4,685,228 A * 8/1987 Gisler et al. ..... 37/233
4,858,270 A * 8/1989 Boschung ..... 15/340.3
5,794,304 A * 8/1998 Ritter ..... 15/340.3
5,884,359 A * 3/1999 Libhart ..... 15/340.3
6,449,800 B1 * 9/2002 Gotham ..... 15/340.3

* cited by examiner

*Primary Examiner*—Theresa T. Snider
(74) *Attorney, Agent, or Firm*—Jenkens & Gilchrist, PC

(57) ABSTRACT

The control apparatus and vehicle of the invention for controlling a broom and blower system attached to the vehicle typically includes several modules (which may be software, hardware, or a combination of these) which interact to process command inputs. Thus, broom state, broom height, and broom direction command modules are all logically connected to a command input module. Similarly, blower state (blower on/off) and direction (blower left/right) modules are also logically connected to the command input module. The method of the invention for operating a broom and a blower includes the steps of receiving a command input, measuring the duration of the command input, and determining whether the command input is a broom state command, a broom height command, a broom direction command, a blower state command, or a blower direction command. If the command is one which requires selection of an intermediate position, then the command is followed as long as the command is entered. If the command is of a relatively short duration, then the command input is latched and held for the length of time required to reach a full-stop position.

11 Claims, 7 Drawing Sheets

BROOM AND BLOWER CONTROL METHOD AND APPARATUS

REFERENCE TO RELATED APPLICATIONS

This application claims the benefit under 35 U.S.C. § 119(e) of U.S. Provisional Application for Patent No. 60/199,053 titled "Improved Truck-Mounted Snow Blowing And Air Blast System For Use In Clearing Snow And Debris From Airport Runways" filed on Apr. 22, 2000, which is incorporated herein by reference in its entirety.

BACKGROUND OF THE INVENTION

1. Technical Field

The present invention relates in general to systems and methods for using brooms and blowers to remove debris from various surfaces. More particularly, the present invention relates to an apparatus and method for controlling an integrated broom and blower system which can be applied to road surfaces, such as an airport runway, to remove snow and other debris which may accumulate thereon.

2. History of Related Art

Truck-mounted systems for removing snow and debris from various road surfaces, such as airport runways, typically include a front-mounted broom and a rear-mounted air blast system, or blower system. Turning now to prior art FIG. 1, it can be seen that as the truck 20 moves over the road surface 10, the rotating broom 40 on the front of the truck 20 contacts the snow or debris 15 on the road surface 10 and brushes the snow or debris 15 to the front and to one side of truck 20. The air blast system or blower system 30 on the truck 20 then blows the snow or debris 15 which has been swept to one side away from the truck 20 and across the road surface 10.

As can be more easily seen in prior art FIG. 2, when it is desired to push the snow or debris 15 to one side of a runway 12, for example the left side 13, the truck 20 moves along the right side 14 of the runway 12 until it reaches the end 70. Upon reaching the end 70 of the runway 12, the operator must re-configure the sweeping and blowing apparatus on the truck 20 by repositioning the broom 40 and redirecting the air blast 50 from the left side of the blower system 30 (as the truck moves toward the end 70 of the runway 12) to the right side of the blower system 30 (as the truck moves away from the end 70 of the runway 12). Note that in the truck 20 moving up the path 60 along the right side 14 of the runway 12, the broom 40 is positioned so that the near end 42 is closest to the left or driver side of the truck 20, at a positive angle Φ. When the truck 20 turns around 80 at the upper end 70 of the runway 12, the angular orientation Φ of the broom 40 with respect to the truck 20 must be changed, and the direction of the air blast 50 from the blower switched from the left side to the right side (i.e., to the direction of air blast 90). This is accomplished by picking up the broom 40 so that the broom bristles are out of contact with the ground and then causing the entire broom head to change its angular orientation with respect to the truck 20, so that the broom 40' is properly re-oriented. Typically the angular orientation Φ is preset to about ±35°, however in special situations, a smaller angle may be used. For the purposes of this document, it will be assumed that a positive angle Φ refers to a "left" broom 40 direction (i.e. the near end 42 of the broom is closest to the driver/left side of the truck, as viewed from a person seated inside the driver's compartment of the truck), and that a negative angle Φ refers to a "right" broom 40' direction (i.e., the far end 41 of the broom is closer to the passenger/right side of the truck, as viewed by someone seated inside the driver's compartment of the truck). Similarly, it will be assumed that "blowing left" 50 means blowing toward the driver/left side of the truck, and that "blowing right" 90 means blowing toward the passenger/right side of the truck.

While the truck-mounted snow brooms and air blast systems found in the prior art and described above have received wide acceptance, they are not without their problems. As described above, changing the direction of the blower system 30 and the angular orientation of the broom 40, 40' keeps the snow or debris 15 moving from the right side 14 of the runway 12 to the left side 13 of the runway 12. Typically, the direction of the air blast from the blower system 30 is controlled by the use of two curved nozzles 32, 34 mounted on either side of the truck 20 (i.e., one nozzle 34 on the left side of the truck 20, and the other nozzle 32 on the right side of the truck 20). Thus, after turning the truck 20 around 80, when it is desired to push the snow or debris 15 to the right side of the truck 20, the nozzle 34 on the left side of the truck 20 is deployed, the right nozzle 32 is stowed, and the blower system 30 causes high velocity air to pass from the left side to the right side of the truck 20 to blow the snow or debris 15 in the same direction that it is pushed by the broom 40.

When the truck 20 comes to the end 70 of the runway 12, the orientation of the broom 40 and the direction of the blower system 30 are both reconfigured for another pass in the opposite direction down the runway 12 (i.e. as the truck 20 changes direction to follow path 100 after following path 60). In prior art systems, the reconfiguration of the truck 20 for the second pass 100 down the runway 12 begins by first changing the nozzles 32, 34 in the blower system 30 on the truck from one side to the other. Following the repositioning of the blower system nozzles 32, 34, the broom 40 in the front of the truck 20 is repositioned. In the prior art, the broom 40 and the nozzles 32, 34 are hydraulically controlled by operating a plurality of hydraulic sequence valves controlled by electric relays.

It is usually up to the operator to match the configuration angle of the broom 40 and the direction of operation for the blower system 30. Using a prior art operator's console, a joy stick is typically used to change the angular orientation Φ of the broom 40. If a broom position is selected other than travel to a full-stop limit, a "cancel" button must be pressed to terminate broom movement as the broom arrives at the selected intermediate position.

In prior art systems, the vertical position of the broom 40 (which determines the amount of contact between the broom bristles and the runway surface 12) is regulated using a mechanical stop located underneath the truck 20. When the operator wants to change the vertical position of the broom 40 with respect to the surface of the runway 12, it is necessary for the operator to crawl under the truck in the snow and debris 15 and physically adjust the position of the mechanical stop. Therefore, about every six hours or so, the bristles wear down and the operator must exit the cab of the truck 20 to reconfigure the broom 40.

Thus, what is needed is a vehicle, apparatus, and method for controlling a broom and blower system which obviates the need for the system operator to closely monitor the state of the broom and blower system, and acts in at least a semi-automatic fashion to reconfigure the broom and blower system after each pass down a road surface, such as a runway. Equally beneficial would be a vehicle, apparatus, and method for controlling a broom and blower system which provide the capability to override automatic reconfiguration under special circumstances, such as for blowing snow off of runway lights, wherein the blower direction does not necessarily correspond to that of the broom head. Such an apparatus and method would save a substantial amount of time, speeding up debris/snow clearance operations significantly. This is especially important when airplanes, potentially low on fuel, are waiting to land on the runway surface. The foregoing and other problems have been addressed by the vehicle, apparatus, and method for controlling a truck-mounted snow broom and blower system of the present invention.

SUMMARY OF THE INVENTION

The apparatus of the invention for controlling a broom and blower system typically includes several interconnected modules (which may be physically realized using software, hardware, or a combination of these) which interact to process command inputs. For example, the operator will typically be able to enter commands to turn the broom on/off (broom state), to move the broom up/down (broom height), and to orient the broom left/right (broom direction), using a push-button console. In the case of adjusting the broom height, or direction, the operator has the choice of moving the broom to a full-stop position, or to some intermediate position, determined by the amount of time the command button is held closed by the operator. Thus, broom state, broom height, and broom direction command modules are all logically connected to a command input module, which receives the operator's commands. Similarly, blower state (blower on/off) and direction (blower left/right) modules are also logically connected to the command input module. It should be noted that some command inputs may also originate from within various parts of the system itself, such as when it is necessary to turn off the blower to stow a blower nozzle (i.e., the command to blow to the right, for example, can also serve as a command input to turn off the blower, tow the right blower nozzle, deploy the left blower nozzle, and turn on the blower).

The apparatus also includes several actuator modules which translate command inputs into appropriate physical motion and/or electrical/hydraulic/mechanical signals so as to operate various elements of the broom and blower system. Thus, the command modules are in logical communication with the blower and broom actuator modules, as well as other system element actuator modules.

The vehicle of the invention includes a broom, a blower system, and the control apparatus, described above. The control apparatus, typically mounted in the cab of the vehicle, acts to operate the rotating broom assembly and the direction blower assembly in an integrated manner, by monitoring command inputs and the state of various aspects of the broom and blower system.

The method of the invention for operating a rotating broom and a directional blower includes the steps of receiving a command input, measuring the duration of the command input, and determining whether the command input is a broom state command, a broom height command, a broom direction command a blower state command, or a blower direction command. If the command is one which requires the possible selection of an intermediate position, e.g., a broom direction command, then the command is followed as long as the operator (or other source of the command) enters the command. If the command is entered for a very short duration, for example, less than a second, then the command input is latched and held for the length of time required to reach a full-stop position. For example, momentary activation of a button on the operator's console causing a short duration broom height command having a value of "UP" to be initiated will typically be latched and held for ten seconds to allow adequate time to raise the broom completely, into its uppermost position.

The disclosed method may also include the steps of extending the left blower nozzle, stowing the right nozzle, actuating an air deflector (to channel air into the left blower nozzle), adjusting the height of an air channel (to duct air efficiently across the road surface), and blowing air to the right of the truck. Similarly, the method may include the steps of extending the right blower nozzle, stowing the left nozzle, actuating an air deflector (to channel air into the right blower nozzle), adjusting the height of the air channel, and blowing air to the right of the truck. If necessary, the blower can also be turned off while the nozzles are re-oriented, and then turned on again.

BRIEF DESCRIPTION OF THE DRAWINGS

A more complete understanding of the structure and operation of the present invention may be had by reference to the following detailed description taken in conjunction with the accompanying drawings, wherein.

DETAILED DESCRIPTION OF PRESENTLY PREFERRED EXEMPLARY EMBODIMENTS

Figure 1:
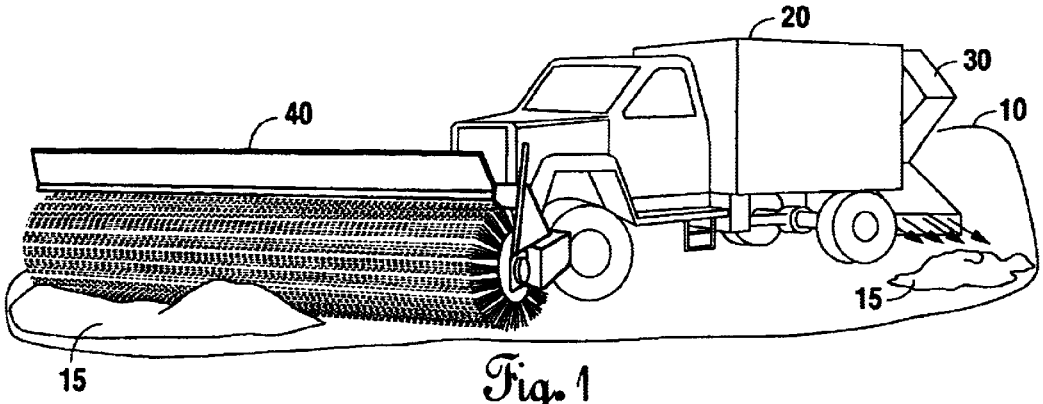
Fig. 1 (PRIOR ART)
FIG. 1, previously described, is a prior art perspective view of a broom and blower system attached to a truck as it removes debris from a road surface.
Figure 2:
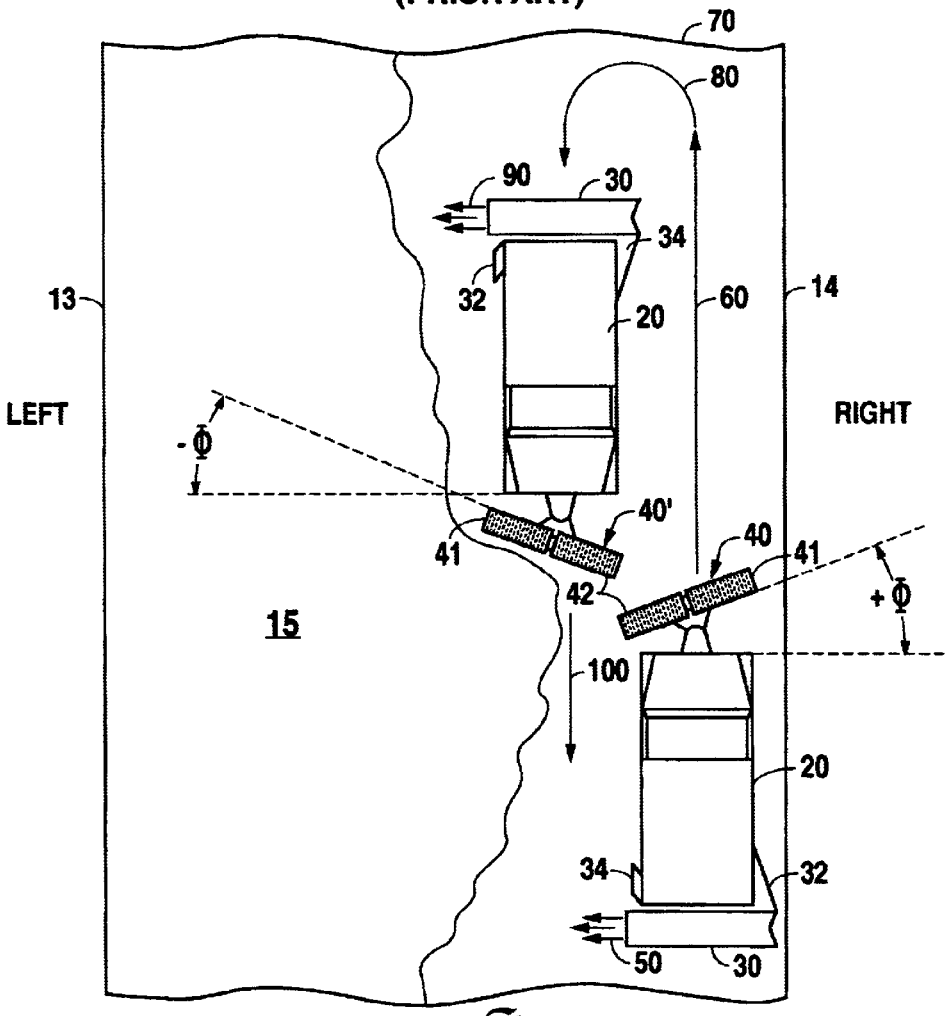
Fig. 2 (PRIOR ART)
FIG. 2, previously described, is a prior art top plan view of a broom and blower system attached to a truck as it operates to make multiple cleansing passes along the surface of a runway.
Figure 3A:
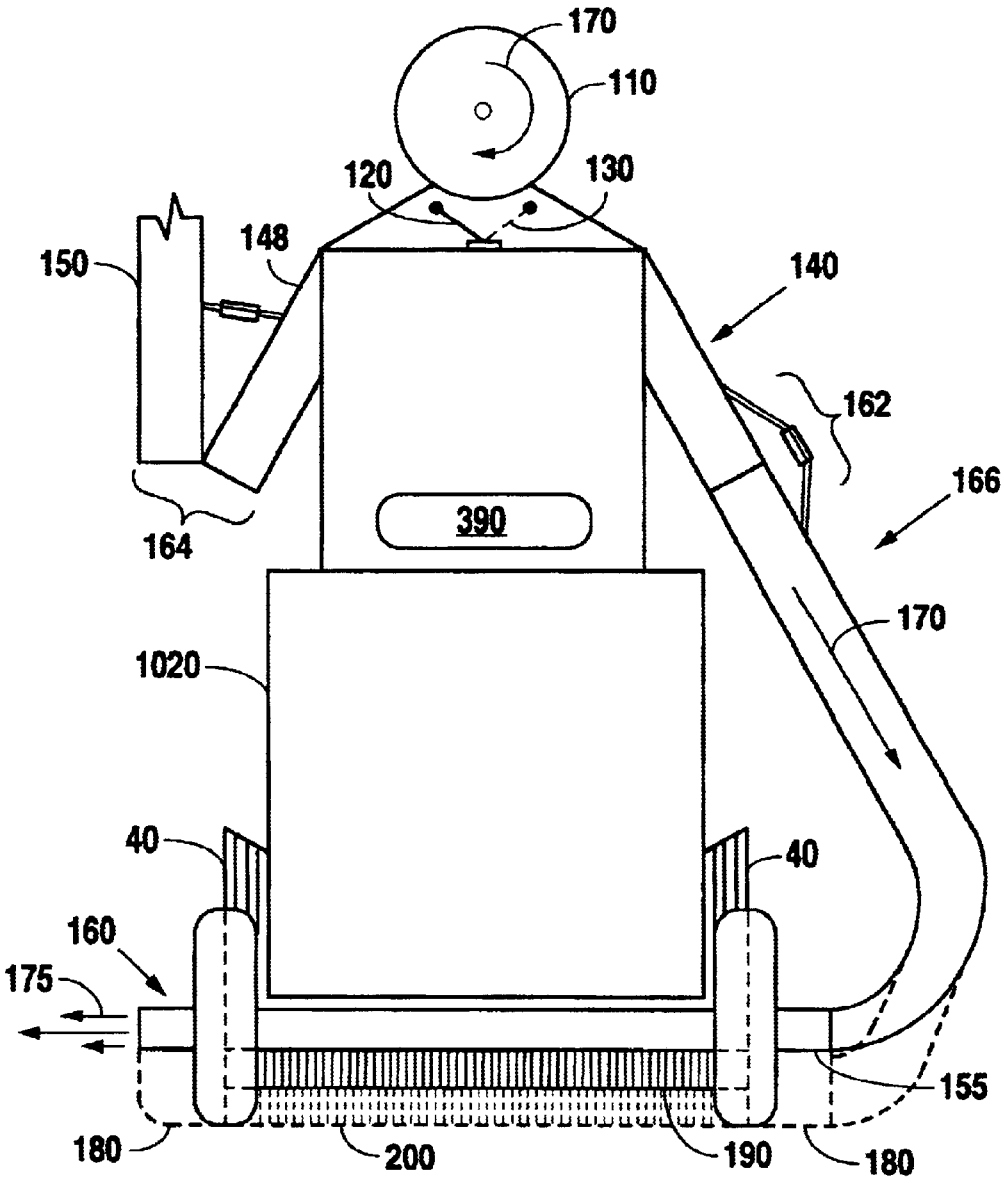
FIG. 3A is a rear view of the vehicle of the present invention including an attached broom and blower system control apparatus.

Turning now to FIG. 3A, the vehicle 1020 of the present invention, including an attached broom 40 and blower system 166 can be seen. The control apparatus or controller 390 is typically located in the cab of the vehicle 1020 for convenient access by the operator.

The blower 110 is typically mounted on top of the vehicle 1020, and a deflector 120 is used to channel the air 170 into the nozzles 162, 164 of the blower system 166. In this case, the air blast 175 emanates from the left side of the vehicle 1020, because the deflector 120 has channeled the air 170 into the right nozzle 162 and on into the air channel 160. The left nozzle 164 is stowed by taking the lower portion 150 of the left nozzle 164 and raising it up next to upper portion 148 of the left nozzle 164. The air channel 160, which can be connected to either of the nozzles 162, 164, is raised/lowered as needed to move over obstacles and provide a more efficient and powerful air blast 175 (due to the vacuum created by placing the air channel 160 in close proximity to the surface which is to be cleared of debris). The raised position 155 of the air channel 160 is shown using solid lines, and the lowered position 180 of the air channel 160 is shown using dashed lines.

Figure 3B:
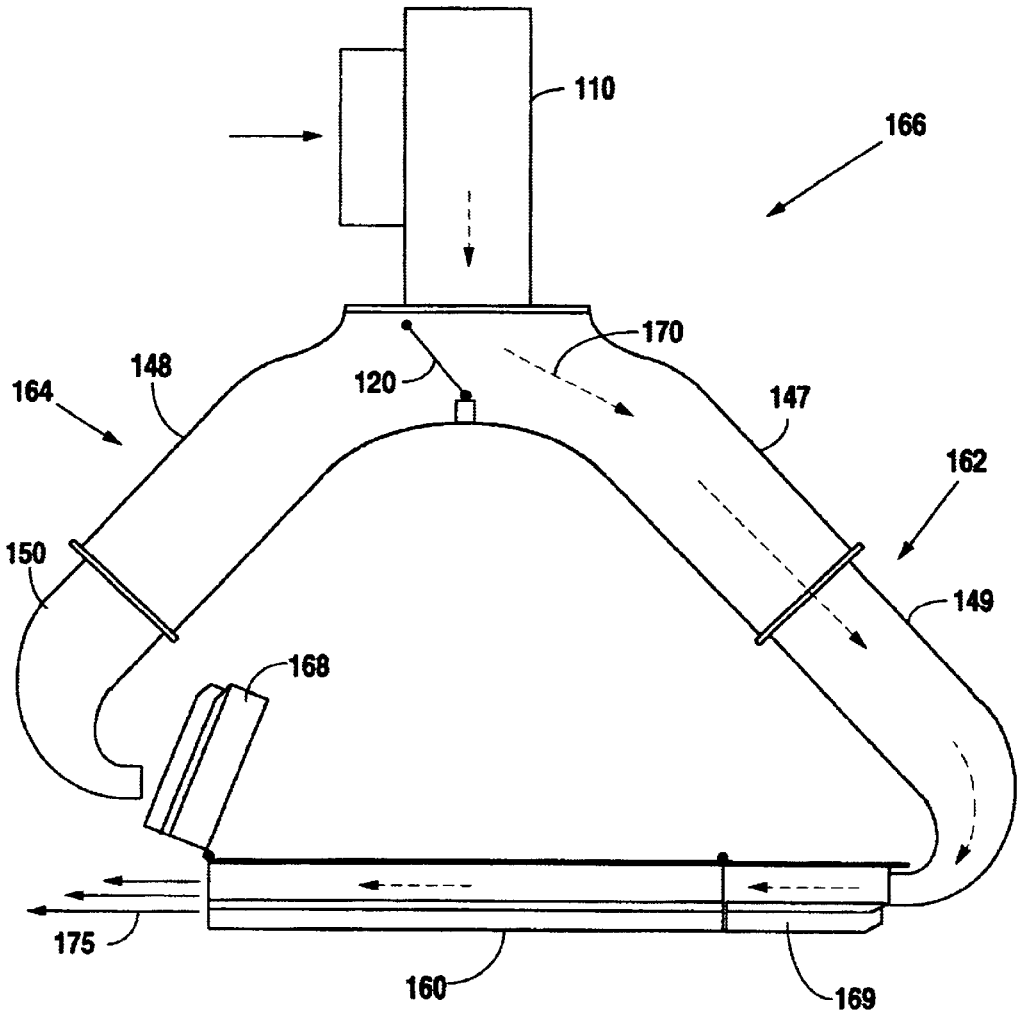
FIG. 3B is a rear view of the blower system of the present invention, blowing to the left.
Figure 3C:
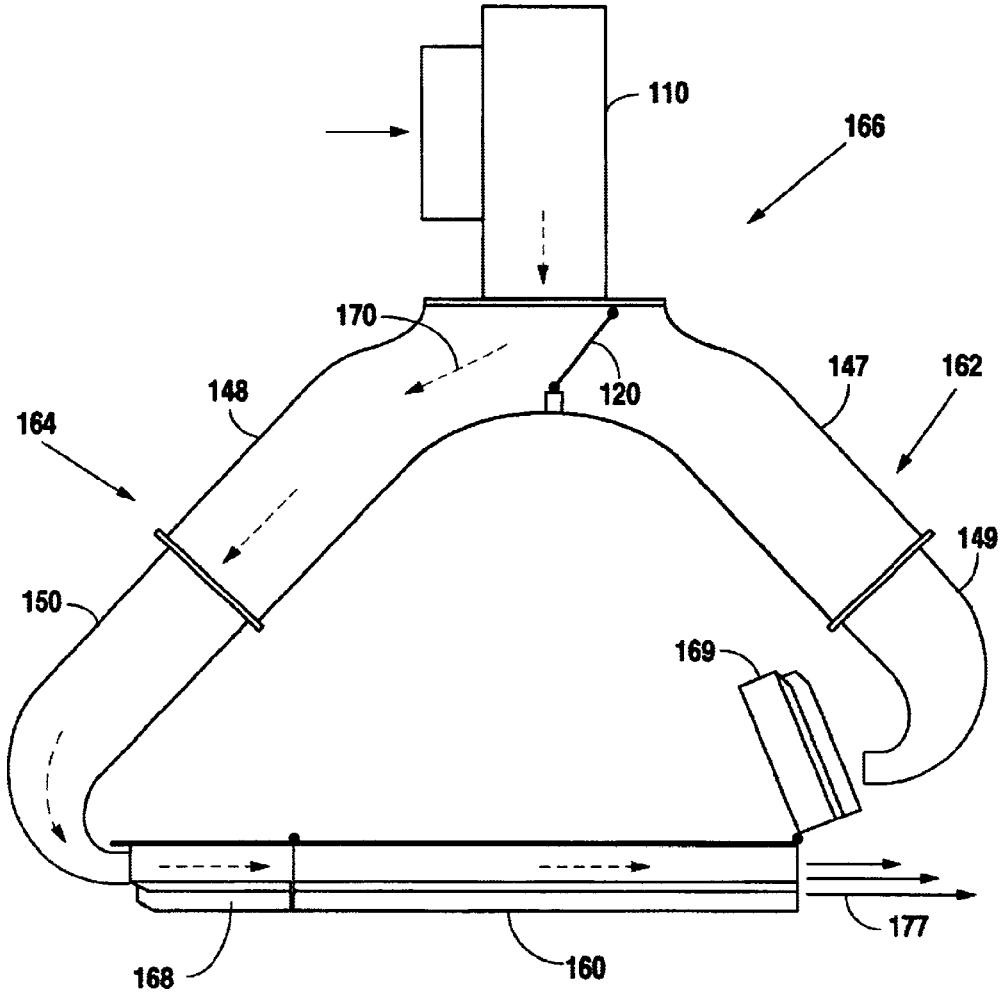
FIG. 3C is a rear view of the blower system of the present invention, blowing to the right.

Further details of the blower system 166 can be seen in FIGS. 3B and 3C. In FIG. 3B, the blower system 166 is shown with the air blast 175 emanating from the left of the system 166. Thus, the blower system 166 is shown in an identical orientation as that illustrated in FIG. 3A. The nozzles 162, 164 can be divided into any number of segments, such as the lower segments 149, 150 and the upper segments 147, 148. Thus, when it is desired to clear debris from the left side of the vehicle, for example, the configuration shown in FIG. 3B can be used. In this case, the air channel 160 combined with the right air channel duct 169, channels the air from the blower 110 through the upper and lower portions 147, 149 of the nozzle 162, through the right air channel duct, the air channel 160, and outwardly from the system 166 in a LEFT direction. The left air channel duct 168 may be raised to allow movement of the left nozzle 164, and/or storage of the left nozzle 164. In a similar fashion, as can be seen in FIG. 3C, when air blast 177 is used to clear debris to the right of the system 166, the deflector 120 can be moved to direct the air 170 through the upper and lower portions 148, 150 of the nozzle 164, through the left air channel duct 168, through the air channel 160 and outwardly in the RIGHT direction, away from the system 166. The right air channel duct 169 can be raised away from the air channel 160 so as to allow movement and/or storage of the right nozzle 162.

Figure 4:
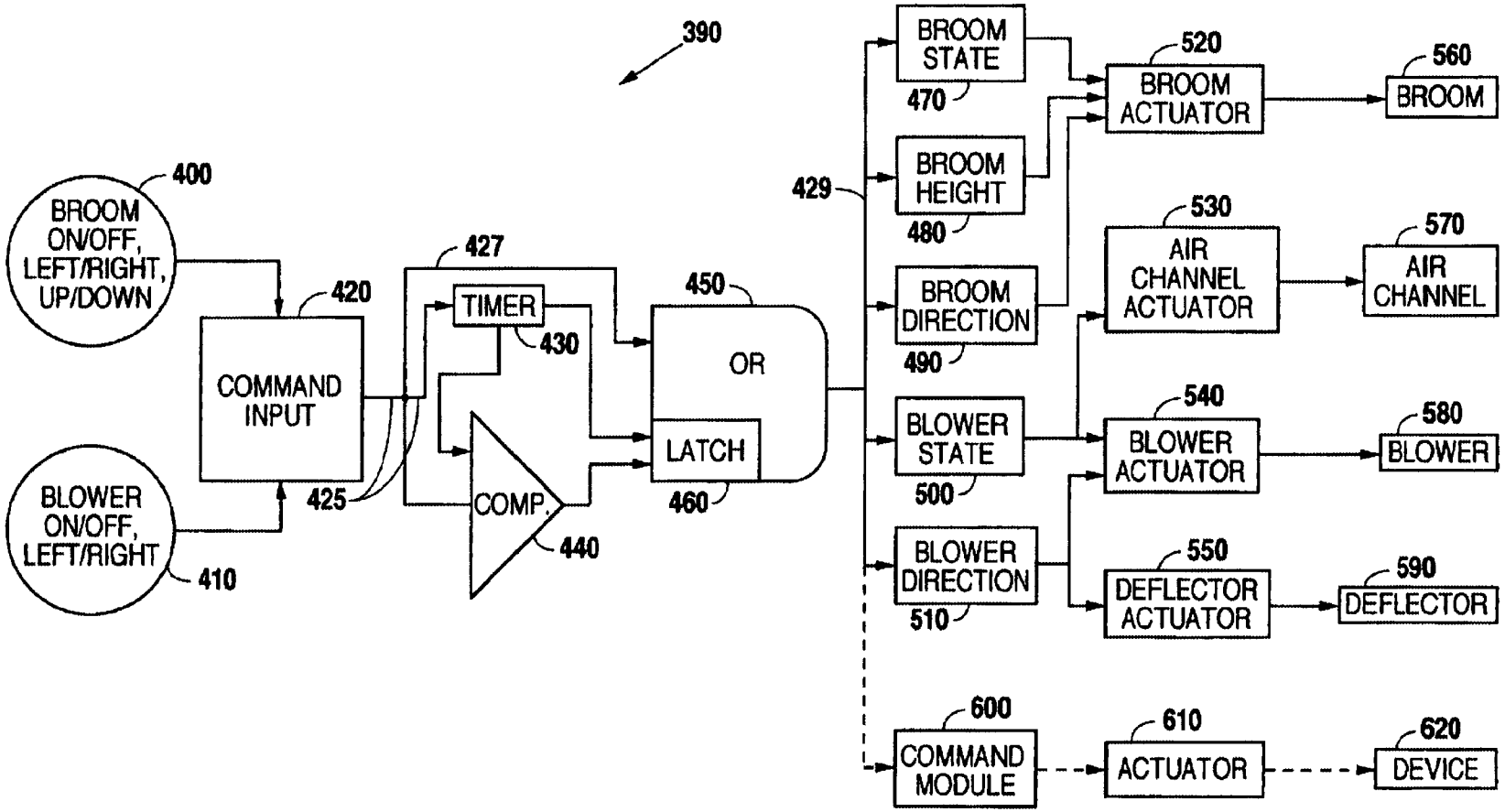
FIG. 4 is a modular block diagram of the control apparatus of the present invention.

Turning now to FIG. 4, the control apparatus or controller 390 of the present invention can be seen. As will be readily apparent to those skilled in the art, many functions of the control apparatus 390 can be implemented using a computer, a microprocessor, a programmable logic controller, or other devices capable of executing programs stored in memory.

The control apparatus 390 includes several different elements, such as the command input module 420, a latch module 460, a timer module 430, a comparator module 440, and several command modules 470, 480, 490, 500, 510, and 600. Each of these modules 420, 430, 440, 460, 470, 480, 490, 500, 510 and 600 may be a software program module, typically stored in memory, a hardware device, such as a circuit and/or mechanical apparatus, firmware, such as may be stored in a read-only-memory, or a combination of these. The control apparatus may also comprise a series of actuators 520, 530, 540, 550, and 610, various devices to be controlled 560, 570, 580, 590 and 620, and elements 400, 410 for sending command inputs to the command input module 420. The actuators 520, 530, 540, 550, and 610, devices to be controlled 560, 570, 580, 590, and 620, and elements 400, 410 may also be implemented as software program modules, electrical and/or mechanical hardware, or firmware, or a combination of these. Each of the elements 400, 410 may be considered to be in "logical communication" with the other elements in FIG. 4. That is, electrical and/or mechanical signals may be transmitted from, for example, the command input module 420 to the timer module 430 and the latch module 460. The idea of "logical communication" includes sending information or commands directly, such as the command input module 420 sending a command input directly to the timer 430 module using signal line 425 or indirectly, such as the command input module 420 sending a command input to the broom state command module 470, via signal lines 425, 427, 429 and the OR-gate 450.

During operation, a command input may originate from a switch, such as a console control button, or possibly a sensor, an internal program module, or some other element or device 400, 410 capable of sending a command input to the command input module 420. For example, if the element 400 takes the form of a push-button on the operator's command console, a command to move the broom UP may be accomplished by pressing the button 400 so as to send the command input to the command input module 420. The command to raise the broom is then passed on to the timer module 430 and the comparator module 440. If the command to raise the broom is entered for less than about one second, for example, the latch module 460 will latch the command for about ten seconds. This allows ample time for the broom to be raised completely to its full-stop "UP" position. However, if the comparator module 440 determines that the command input 420 has been entered for a period of time which exceeds one second, for example, then the command is not latched by the latch module 460, and the command will simply be followed using the OR-gate 450 for as long as the operator enters the command. That is, as long as the button 400 is held down, the command to raise the broom will be sent to the broom height command module 480 for execution by the broom actuator module 520. Thus, the command (latched or otherwise) is passed on through the OR-gate 450 to the appropriate command module; in this case, the broom height command module 480. Thus, while the broom 40 can be raised to an "UP" position 190 or lowered to a "DOWN" position 200, the broom 40 can move to any number of intermediate positions between the raised position 155, and the lowered position 180.

The broom height command module 480 in turn, may immediately pass the command on to the broom actuator module 520, which directly controls the broom 560. Depending on the specific design of the control apparatus 390, the broom height command module 480 may also check the immediate command input against the condition of the other command modules 470, 490, 600 to determine whether raising the broom at the particular time commanded by the operator is an appropriate action. For example, if the broom has already been raised to a full-stop "UP" position, then raising the broom again is not necessary, and no command will be presented to the broom actuator 520.

Thus, several command inputs may be received and determined by the command input module 420. Such command inputs may originate with the operator, a sensor, or from a module 470, 480, 490, 500, 510, 520, 530, 540, 550, 560, 570, 590, 600, 610, and 620 within the control apparatus 390 itself. For example, various broom command inputs may have a value of "ON" to turn the broom on and begin rotation of the bristles, "OFF" to turn the broom off and stop rotation of the bristles, "LEFT" to begin moving the broom toward the left direction (i.e., with the near end of the broom closest to the driver in the truck cab), "RIGHT" to move the broom in a right direction (i.e., to move the far end of the broom closer to the passenger portion of the truck cab), and, as mentioned previously, "UP" to raise the broom, and "DOWN" to lower the broom. Any of these commands may be asserted as a command to effect a full-stop position change or, as a command to move to some intermediate position between extremes.

Similarly, several blower commands may be entered by the operator, a sensor, and/or the control apparatus 390 itself, including a range of elements 410, such as a push button, a software program module, electrical/mechanical hardware, or firmware. Blower commands include "ON" to turn the blower on, "OFF" to turn the blower off, "LEFT" to engage the blower system to blow to the left of the vehicle, and "RIGHT" to engage the blower system to blow to the right of the vehicle.

As can be seen in FIG. 4, there are several command modules 470, 480, 490, 500, 510, and 600 which can be used for receiving and evaluating commands originally received and/or determined by the command input module 420. The broom state command module 470 is responsible for receiving and/or evaluating commands to turn the broom ON/OFF, or to adjust its rotational speed. The necessary signals are sent from the broom state module 470 to the broom actuator module 520 to effect direct control of the broom 560. Similarly, the broom height command module 480 is responsible for receiving and/or evaluating broom height command inputs. The height commands may have a value of ON/OFF, which to move the broom to an extreme upward or downward position. The broom height commands may also be of a variable nature, such that the broom may be moved to some intermediate position. Finally, the broom direction command module 490 is responsible for receiving and/or evaluating commands to orient the broom according to an angle Φ, as previously described. The broom will be angled to the right if the value of the broom direction command is "RIGHT". Similarly, the broom will be angled to the left if the value of the broom direction command is "LEFT". The broom state command module 470, broom height command module 480, and broom direction command module 490, are all in logical communication with the broom actuator 520, which in turn includes relays, solenoids, hydraulic actuator mechanisms, and other devices well known to those skilled in the art to effect control of the broom 560.

Blower commands are received by the command input module 420 and are passed on, eventually, to the blower state command module 500 and the blower direction command module 510. These modules 500, 510 operate in a manner similar to the broom modules 470, 480, 490; that is, the blower state command module 500 is responsible for receiving and evaluating commands to turn the blower ON/OFF. Appropriate signals are sent to the blower actuator module 540 and/or the air channel actuator 530 to effect control of the blower 580 and the air channel 570 respectively. The blower direction command module 510 is responsible for receiving and/or evaluating commands which direct the blower system to blow LEFT or RIGHT. Appropriate signals are sent to the blower actuator 540 to effect physical control of the blower 580 and the deflector 590. Actuator modules 540, 550 typically include electrical, hydraulic, and/or mechanical components to effect physical control of the blower 580 and the deflector 590.

Generic command modules 600 may also be included in the controller 390, such as those for broom height calibration, dump cover movement, air channel end flaps, control the broom pump, and the blower pump. Commands received to operate these generic devices, or other devices, can be received and/or evaluated by the command module 600, and sent on to the generic actuator module 610 in an appropriate form to operate the device 620 being commanded. Thus, for example, if the command module 600 is for broom height calibration, the actuator 610 may signal the device 620 (i.e., in this case the broom) to move to some preselected position where a sensor will determine the absolute height of the broom above the surface to be cleaned and the current length of the bristles (i.e., the bristle wear state). If the bristles are found to be worn beyond usefulness due to abrasion, then the operator may be signaled to effect their replacement. These and many other operational scenarios may be imagined by those of ordinary skill in the art with regard to receiving and/or evaluating command inputs, and actuating a device based on the command input, and other commands received as command inputs.

Figure 5A:
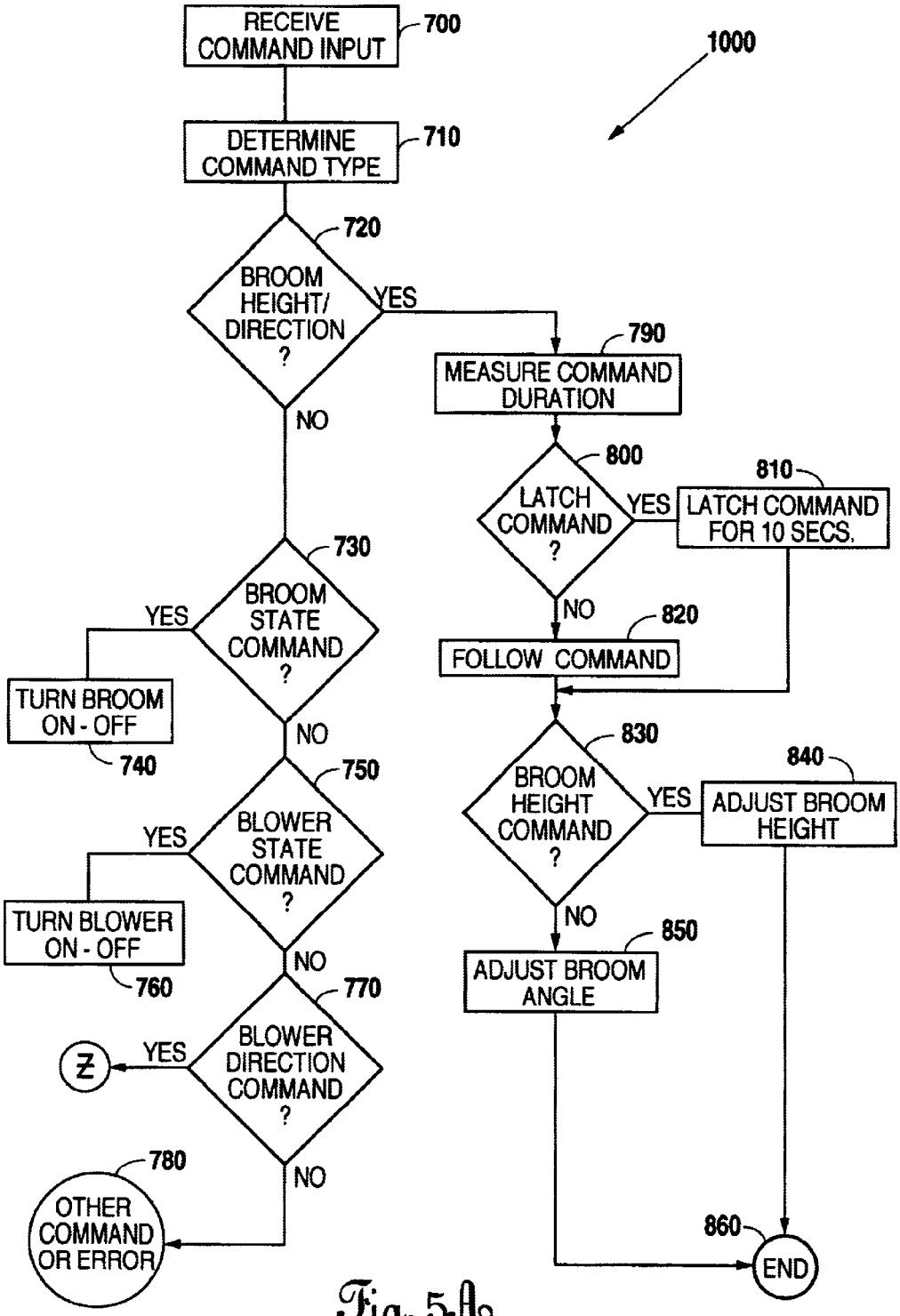
FIG. 5 is a flowchart diagram of the method of the present invention.
Figure 5B:
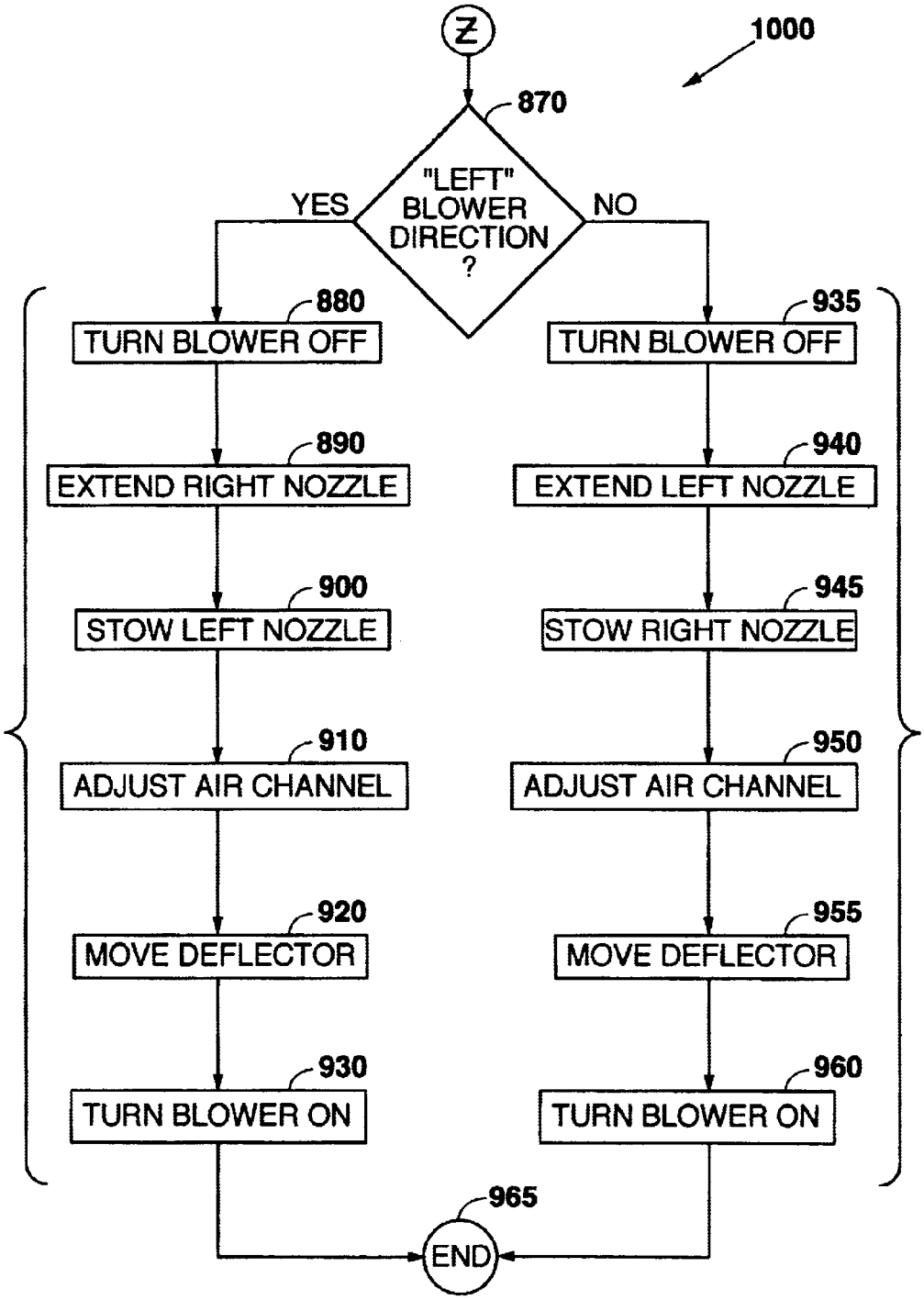

Turning now to FIGS. 5A and 5B, the method of the invention can be seen. The method begins at step 700 with receiving a command input. The method further includes the steps of determining whether the command input is a broom state command, a broom height command, a broom direction command, a blower state command, or a blower direction command. Thus, the command type determined in step 710 may be any one of those specifically mentioned, or one of many others, as described above with regard to generic command modules, actuator modules, and devices which form a part of the specific configuration of the vehicle 1020 and/or control apparatus 390 of the invention. If the command type is determined to be a broom height or direction command in step 720, then the duration of the command is measured in step 790. If the duration of the command input is less than a predetermined input command input time, for example if the duration is less than about one second, then the command is latched for a predetermined latch time, for example for about ten seconds. Otherwise, if the duration of the command is determined to be greater than about one second, then the command input will be followed for the duration of the command input in step 820. In either case, the command will be followed, or latched, and if the command type is determined to be a broom height command in step 830, for example, the broom height will be adjusted in step 840. If the command is latched in step 810, then the broom height will be adjusted to a full-stop position (i.e., either all the way UP or all the way DOWN, depending on the value of the command input). However, if the command type is not a broom height command, then the command type must be a broom direction command (reference step 720), and the broom angle or direction will be adjusted in step 850. Again, the broom will be angled to the LEFT or RIGHT to a full-stop position (if the command is latched) or to an intermediate position determined by the length of time the command is entered by the operator and followed in step 820. After the broom height or direction are adjusted in steps 840, 850, the method ends in step 860.

If the command type is not a broom height or direction command, as determined in step 720, then a determination is made as to whether the command type is a broom state command in 730. If so, then the broom can be turned on if the value of the broom state command is ON, or the broom can be turned off if the value of the broom state command is OFF in step 740. Similarly, if it is determined that the command type is a blower state command in step 750, then the blower can be turned on if the value of the blower state command is ON, or the blower can be turned off if the value of the blower state command is OFF in step 760. Finally, if the command type is not a blower direction command, as determined in step 770, then the control apparatus will determine that some other generic command has been entered, or an error has occurred in step 780. However, if the command type is a blower direction command, as determined in step 770, then the control apparatus will determine whether the value of the blower direction command is LEFT or RIGHT. If the value of the blower direction command is LEFT, as determined in step 870, then the necessary actions to move the nozzles into the correct position for blowing to the left of the vehicle can be effected. For example, the blower can be turned off in step 880, the right nozzle can be extended in step 890, the left nozzle can be stowed in step 900, the air channel height can be adjusted in step 910, the deflector can be moved in step 920, and the blower can be turned back on 930 so that the blower system can blow to the LEFT. At this point, the method ends at step 965.

Similarly, if the value of the blower direction command is RIGHT, then the necessary steps can be taken so that the blower system will blow to the RIGHT. These may include the steps of turning the blower off in step 935, extending the left nozzle in step 940, stowing the right nozzle in step 945, adjusting the air channel height in step 955, and turning the blower back on in step 960. After these steps, the method ends in step 965.

As described previously, a significant part of operating prior art vehicles and broom/blower systems is the proper sequencing of the position of the broom and the position of the blower system to remove swept snow and debris from the roadway surface. Typically, the operator is responsible for obtaining and maintaining the correct position of the broom and blower system for left/right debris removal, being that each system is individually controlled. Using the improved vehicle and the apparatus of the present invention, numerous relays and other complex circuitry used to control hydraulic value sequencing can now be replaced with a programable logic controller. Eliminating the relays and complex circuitry found in the prior art also reduces the complexity of the hydraulic system needed for implementing the various actuator modules 520, 530, 540, 550, and 610. Thus, using a programable logic controller or other programable apparatus enables the operator to significantly reduce the amount of time required to reconfigure the vehicle for return passes along a road surface or runway. Rather than reconfiguring the position of the blower system nozzles, and then following with a change in the angular orientation of the broom, the vehicle, apparatus, and method of the present invention can be adapted to make a change in the angular orientation of the broom first. By changing the position of the broom first the vehicle is able to begin the next pass down the runway while the nozzles of the blower system are still moving into position. This enables faster turnaround. If desired, however, the control apparatus 390 is flexible enough to sequence the nozzles first, followed by the broom, as in prior art systems. In addition, the control apparatus 390 used on the improved vehicle 1020 of the present invention will assure that the proper nozzle is in position with respect to the position of the broom head. Further, the control apparatus 390 will allow the operator to use just the broom, just the blower system, or both the broom and blower system together. If desired, the operator may put the nozzles on the opposite side of where they are normally positioned to remove snow from runway lights, for example. And the control apparatus 390 can be set up to monitor the position of the broom and the nozzles continuously, even to the point of using feedback to make adjustments, in contrast to prior art systems which left this task up to the operator.

Thus, using the improved vehicle 1020, control apparatus 390, and method 1000 of the invention, if the operator desires to push snow to the left side of the vehicle, the operator can simply push the "broom left" button on a control console located in the cab of the vehicle for less than a second. This action causes the broom to move left to a preset angle usually about (30°–35°) and automatically sequences the blower, deflector, and nozzles to blow air from the right side of the vehicle 1020. If the operator desires to position the broom at some other angle than the full-stop preset angle, the operator simply maintains pressure on the broom position button for more than one second, so that the broom will be commanded to move as long as the button is held down. If pressure is removed from the button, the broom will stop moving.

Although preferred embodiments of the method and apparatus of the present invention have been illustrated in the accompanying Drawings and described in the foregoing Detailed Description, it will be understood that the invention is not limited to the embodiments disclosed, but is capable to numerous rearrangements, modifications and substitutions without departing from the scope of the invention as set forth and defined by the following claims.

What is claimed is:

1. A control apparatus for controlling a rotating broom and a directional blower for removing debris from surfaces, said control apparatus comprising:

a command input module for receiving command inputs concerning the operation or position of the rotating broom and/or the position and operation of the directional blower;

a latch module in logical communication with said command input module for holding command inputs;

a timer module in logical communication with said command input module;

a comparator module in logical communication with said command input module, and said timer module for activating said latch module;

a broom state command module for controlling the rotation of the broom in logical communication with said command input module;

a broom height command module for controlling the height of the broom with respect to the surface in logical communication with said command input module;

a broom direction command module for controlling the direction of the broom in logical communication with said command input module;

a blower state command module for controlling the operation of the directional blower in logical communication with said command input module; and a blower direction command module for controlling the direction of air flow in logical communication with said command input module.

2. The control apparatus of claim 1, further comprising:

a blower actuator module in logical communication with said blower state command module.

3. The control apparatus of claim 1, further comprising:

a blower actuator module in logical communication with said blower direction command module.

4. The control apparatus of claim 1, further comprising:

a broom actuator module in logical communication with said broom state command module.

5. The control apparatus of claim 1, further comprising:

a broom actuator module in logical communication with said broom direction command module.

6. The control apparatus of claim 1, further comprising:

a generic actuator module in logical communication with said command input module.

7. A vehicle including a rotating broom and a direction blower for removing debris from a road surface, comprising:

a rotating broom assembly;

a directional blower assembly; and a control apparatus for controlling the operation of the rotating broom assembly and the directional blower assembly, said control apparatus including:

a command input module for receiving command inputs concerning the position of the rotating broom assembly and the directional blower assembly;

a latch module for holding command inputs in logical communication with said command input module;

a timer module for measuring the duration of the command input in logical communication with said command input module;

a comparator module in logical communication with said command input module, and said timer module for activating said latch module;

a broom state command module for controlling the rotation of the broom in logical communication with said command input module;

a broom height command module for controlling the height of the broom with respect to the surface in logical communication with said command input module;

a broom direction command module for controlling the direction of the broom in logical communication with said command input module;

a blower state command module for controlling the operation of the directional blower in logical communication with said command input module; and a blower direction command module for controlling the direction of the directional blower in logical communication with said command input module.

8. The vehicle of claim 7, further comprising:

a blower actuator module in logical communication with the blower state command module.

9. The vehicle of claim 7, further comprising:

a blower actuator module in logical communication with the blower direction command module.

10. The vehicle of claim 7, further comprising:

a broom actuator module in logical communication with the broom state command module.

11. The vehicle of claim 7, further comprising:

a broom actuator module in logical communication with the broom direction command module.

* * * * *